US007658625B2

(12) United States Patent
Jubelirer et al.

(10) Patent No.: US 7,658,625 B2
(45) Date of Patent: Feb. 9, 2010

(54) AC POWER ADAPTER WITH SWIVELING PLUG HAVING FOLDING PRONGS

(75) Inventors: Matthew Jubelirer, San Diego, CA (US); Gary Rensberger, Redmond, WA (US); Jeffrey A. Griffis, San Carlos, CA (US); Carl Joseph Ledbetter, Mercer Island, WA (US); William J. Lauby, Mukilteo, WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 12/043,952

(22) Filed: Mar. 7, 2008

(65) Prior Publication Data

US 2009/0227122 A1 Sep. 10, 2009

(51) Int. Cl.
*H01R 13/44* (2006.01)

(52) U.S. Cl. ..... 439/131; 439/954

(58) Field of Classification Search ..... 439/113, 439/115, 131, 281, 282, 606, 655, 736, 954; 320/107, 111, 114

See application file for complete search history.

(56) References Cited

U.S. PATENT DOCUMENTS

| | | | | |
|---|---|---|---|---|
| 5,423,690 | A | 6/1995 | Selker et al. | |
| 5,547,399 | A | 8/1996 | Naghi et al. | |
| 5,613,863 | A * | 3/1997 | Klaus et al. | 439/131 |
| 5,628,641 | A * | 5/1997 | Hahn | 439/131 |
| 5,648,712 | A | 7/1997 | Hahn | |
| 5,955,797 | A | 9/1999 | Kim | |
| 6,126,460 | A * | 10/2000 | Wu | 439/131 |
| 6,275,002 | B1 * | 8/2001 | Chen | 320/111 |
| 6,386,921 | B1 | 5/2002 | Casari | |
| 6,638,113 | B2 | 10/2003 | Kajiwara et al. | |
| 6,669,495 | B2 | 12/2003 | Philips et al. | |
| 6,764,321 | B2 | 7/2004 | Machado | |
| 6,821,134 | B2 * | 11/2004 | Chen | 439/131 |
| 6,934,170 | B2 | 8/2005 | Ooishi | |
| 7,125,257 | B1 * | 10/2006 | Liang | 439/22 |
| 7,156,673 | B2 * | 1/2007 | Son | 439/131 |
| 2006/0108979 | A1 | 5/2006 | Daniel et al. | |

OTHER PUBLICATIONS

"iPod Travel Power Charger/Adapter", http://tinyplug.manufacturer.globalsources.com/si/6008822397298/pdtl/iPod-accessory/1003604916/iPod-Travel-Power-Charger-Adapter.htm.

"Microsoft Zune AC Adaptor", https://www1.datavis.com/Microsoft_Zune_AC_Adaptor.html.

"Motion Computing AC Power Pack", http://www.digitalgraphicsresources.com/browseproducts/Motion-Computing-AC-Power-Pack.HTML.

* cited by examiner

*Primary Examiner*—Thanh-Tam T Le

(57) ABSTRACT

An external AC power adapter is provided in a compact form factor that utilizes an AC plug that swivels about the body of the adapter and that includes prongs (i.e., electrical contacts or terminals) which can fold into the body for transport or storage. The swiveling AC plug enables the body of the AC power adapter to be rotatably oriented in a user-selectable manner in order to fit in tight spaces when plugged in to maximize the utilization of available outlets. The foldable prongs help to minimize the overall size of the AC power adapter for easy portability and storage. When folded, the prongs are protected against damage and are prevented from damaging or scratching other articles when the AC power adapter is packed in a bag or suitcase during travel.

20 Claims, 6 Drawing Sheets

AC POWER ADAPTER WITH SWIVELING PLUG HAVING FOLDING PRONGS

BACKGROUND

Many consumer products and portable electronic devices need to convert an AC (alternating current) power input provided by electrical mains or power lines in a home or office into a DC (direct current) power output that is required to operate the device's circuitry or, in the case of portable electronic devices, charge an internal rechargeable battery. An external AC power adapter is often used for such a purpose which is typically configured to house the AC energized components in a secure manner to safeguard against injury that may result from inadvertent user contact.

In addition to performing its primary function of converting an AC input into a DC output having characteristics suitable for the device's circuitry or battery, an external AC power adaptor enables the electronic device to be made smaller and lighter because the size and weight of the AC power adapter circuitry, along with its housing or other safety features, is located outside of the device.

With the widespread popularity of electronic devices, users are increasingly incorporating multiple devices into their lifestyles. In the case of portable electronic devices that utilize rechargeable batteries, users often find themselves needing to recharge the batteries every day. This can result in a situation where multiple AC adapters must share the same power strip or wall outlet. As the AC adapters can be bulky in size, they often compete for space and can end up crowding any open outlet and thus prevent other adapters from being plugged in. Accordingly, it would be desirable to have an AC power adapter form factor that can be used with crowded outlets and in small spaces.

AC adapters are also desired that can better meet the needs of international travelers. In this situation, travelers must cope with power outlet configurations that vary throughout the world.

This Background is provided to introduce a brief context for the Summary and Detailed Description that follow. This Background is not intended to be an aid in determining the scope of the claimed subject matter nor be viewed as limiting the claimed subject matter to implementations that solve any or all of the disadvantages or problems presented above.

SUMMARY

An AC power adapter is provided in a compact form factor that utilizes an AC plug that swivels about the body of the adapter and that includes prongs (i.e., electrical contacts or terminals) which can fold into the body for transport or storage. The swiveling AC plug enables the body of the AC power adapter to be rotatably oriented in a user-selectable manner in order to fit in tight spaces when plugged in to maximize the utilization of available outlets. The foldable prongs help to minimize the overall size of the AC power adapter for easy portability and storage. When folded, the prongs are protected against damage and are prevented from damaging or scratching other articles when the AC power adapter is packed in a bag or suitcase during travel.

In various illustrative examples, the AC power adapter is configured with worldwide voltage handling capability along with a user-detachable and interchangeable face plate that incorporates the swiveling AC plug with folding prongs. International travelers can readily swap face plates having different plug types without tools so that the AC power adapter with an appropriate prong arrangement can be plugged into a local outlet. Utilization of the detachable and interchangeable face plate can also improve manufacturing and distribution efficiency for AC power adapters that are sold on a multi-region or worldwide basis. A commonly-utilizable AC power adapter body design may be manufactured for all markets while being easily configurable to meet the needs of a given region by the addition of a region-specific faceplate/AC plug to the commonly-utilizable body.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DESCRIPTION OF THE DRAWINGS

Like reference numerals indicate like elements in the drawings. Elements are not drawn to scale unless otherwise indicated.

DETAILED DESCRIPTION

Figure 1:
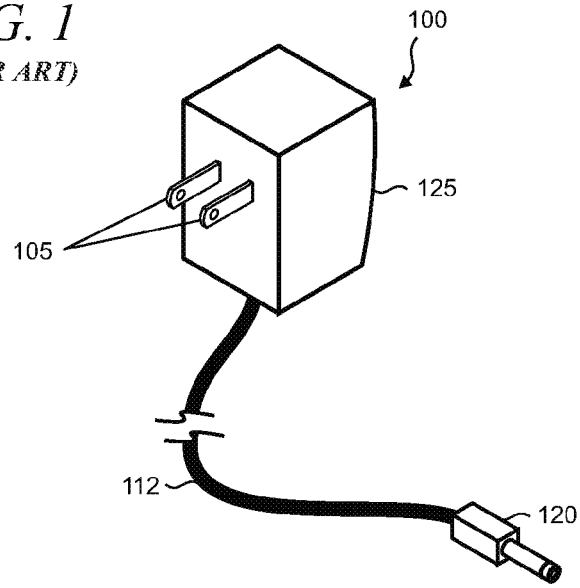
FIG. 1 (PRIOR ART)
FIG. 1 is a pictorial view of a conventional AC power adapter.

FIG. 1 is a pictorial view of a conventional AC power adapter 100 that is representative of existing adapters that are commonly used to power electronic devices that use DC power to run their circuitry or to charge an internal battery. The AC power adapter receives AC power from an AC outlet (i.e., receptacle) through a pair of prongs 105 and outputs DC power by way of a wire 112. A connector such as a friction-fit plug 120 interfaces with a mating jack in the electronic device to receive the DC power.

A power conversion circuit is contained within the body 125 of the AC power adapter that performs the AC to DC power conversion. The power conversion circuit commonly is configured with worldwide power conversion capability so that it outputs an intended (i.e., designed-for) nominal DC power with variable input AC power. For example, the AC power adapter 100 may be configured to be usable with the two basic standards for AC line voltage: the North American standard of 110-120 V at 60 Hz, and the European standard of 220-250 V at 50 Hz.

The prongs 105 are male electrical connectors that interface mechanically and electrically with corresponding mating female connectors in an AC outlet. Prongs are also commonly referred to as pins, contacts, or terminals. In this example, the prongs 105 interface with respective live (i.e., "hot") and neutral connectors in the AC outlet using an unpolarized plug configuration where both prongs 105 are the same width (from top to bottom in FIG. 1). This allows the AC power adapter 100 to be plugged into the AC outlet in one direction or rotated 180 degrees and plugged in in the opposite direction, as either prong 105 may interface with either the hot or neutral contact.

The prongs 105 here comprise two flat parallel blades that are configured in compliance with NEMA 1-15 (National Electrical Manufacturers Association), CSA-C22.2 No. 42 (Canadian Standards Association), and JIS C 8303 (Japanese Industrial Standard). Prongs 105 are also referred to as a Type A connector or plug. In alternative embodiments, other prong and plug arrangements, for example the Type C Europlug, may also be utilized as described below in the text accompanying FIG. 18.

The AC power adapter body 125 is typically configured as a sealed resilient assembly to protect the energized power conversion circuitry. The body 125 also isolates such components as energized components from children, pets, and the like that may unknowingly attempt to access the components. The prongs 105 are commonly configured to project from the body 125 so that the AC power "plug" functionality is integrated within the body 125. While a separate plug may be utilized, which is typically coupled with a wire carrying AC power to the body configured as "brick", an integrated plug and body configuration is commonly used to minimize cost of the AC power adapter.

Figure 1A:
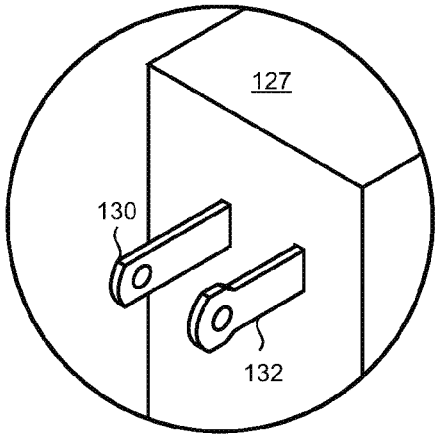
FIG. 1A (PRIOR ART)
FIG. 1A is an enlarged pictorial view of an AC power adapter that uses an alternative polarized plug configuration.
Figure 1B:
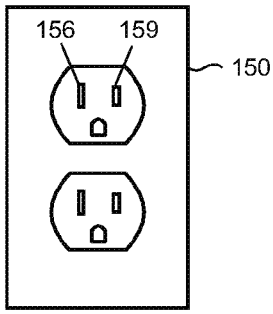
FIG. 1B (PRIOR ART)
FIG. 1B shows a conventional duplex AC receptacle that is configured to accept a polarized plug.

FIG. 1A shows an enlarged detail view of an alternatively-utilized polarized plug configuration in an AC power adapter 127 where one of the prongs 132 is wider (from top to bottom in FIG. 1A) than the other prong 130. The wider prong 132 is sized to interface with the neutral contact that is accessible through a bigger opening in a conventional AC outlet, while the narrower prong 130 interfaces with the hot contact that is accessible through a smaller opening in the outlet. A conventional duplex outlet 150 is shown in FIG. 1B, where the neutral and hot contacts are respectively indicated by reference numerals 156 and 159. A polarized plug can only engage with an outlet in one orientation (i.e., the prongs cannot be plugged in in a reverse manner so that the live prong is inserted into the neutral contact and vice versa). Polarized plug configurations are used with some electronic device designs, for example, those that incorporate switches that are intended to disconnect the hot side of the AC circuit. In this case, the polarized plug ensures that the live and neutral contacts are connected as intended to the live and neutral conductors in the device.

Figure 2:
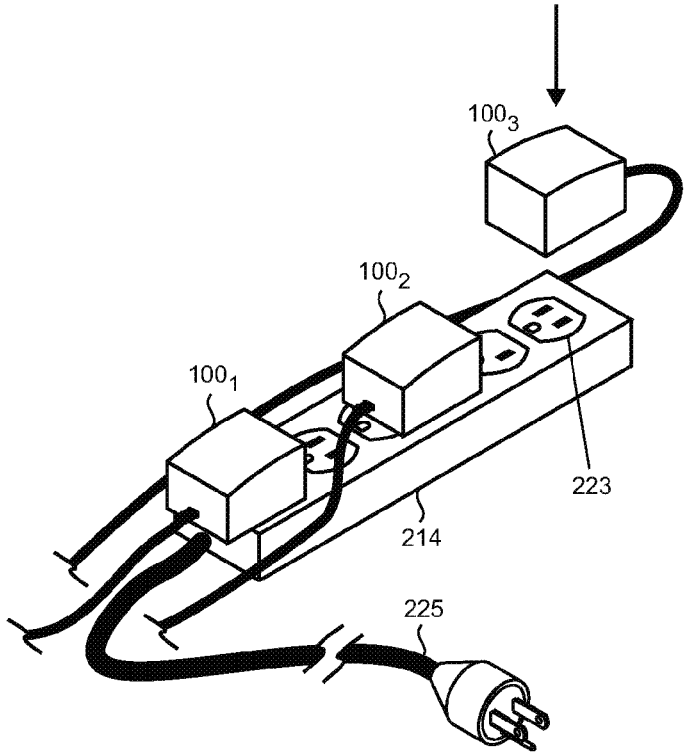
FIG. 2 (PRIOR ART)
FIG. 2 is a pictorial view of a group of AC power adapters being used with a multiple-outlet power strip.

While AC power adapters with integrated plug and body are satisfactory in many situations, one significant drawback is that they tend to be bulky so that it can be difficult to find space around an AC outlet to plug them in. For example, FIG. 2 is a pictorial view of a group of AC power adapters $\mathbf{100}_{1,2,3}$ being used with a multiple-outlet power strip 214. The power strip 214 in this example has six outlets (where a representative outlet is indicated by reference numeral 223. While the outlet configuration may vary, it is common to use an outlet spacing (nominally 1½ inches) that is similar to that found in standard duplex wall outlets that conform, for example with NEMA 5-15. Power strip 214 includes a power cord 225 having a plug that plugs into an AC power source such as a wall outlet. Power strip 214 may also include an on-off switch or circuit breaker (also not shown).

As shown in FIG. 2, the AC power adapters 100 are big enough in size so that each obstructs an adjacent outlet on the power strip 214 when plugged in. In other words, an AC power adapter 100 takes up more than one outlet "space" that is available on the power strip 214 (where the power strip has six "spaces" that correspond to the six outlets 223). Thus, as shown in FIG. 2, the six available outlets 223 can provide AC power to only three adapters 100. It is further noted that the AC power adapter $\mathbf{100}_3$ is shown as being inserted in a reverse orientation as adapters $\mathbf{100}_1$ and $\mathbf{100}_2$. As described above, the AC power adapter $\mathbf{100}_3$ would not be able to be plugged in such a reverse orientation if it uses a polarized plug configuration as shown in FIG. 1A.

Figure 3:
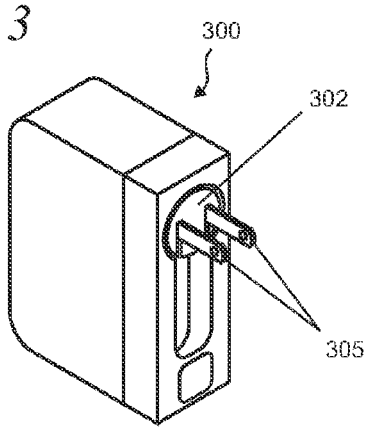
FIG. 3 is a pictorial view of an illustrative AC power adapter that has a swiveling plug with foldable prongs where the prongs are extended.

Referring now to FIG. 3, a pictorial view is provided of an illustrative AC power adapter 300 that has a swiveling plug 302 with foldable prongs 305. The prongs 305 in this example are Type A flat-bladed prongs in an unpolarized plug configuration that are usable with outlets in North American, Japan, portions of southeast Asia, and portions of South America, for example. However, the present arrangement is not limited to unpolarized plug configurations. In alternative implementations, it may be desirable to utilize a polarized plug where one prong is wider than the other to interface with a polarized outlet in a given orientation.

Figure 3A:
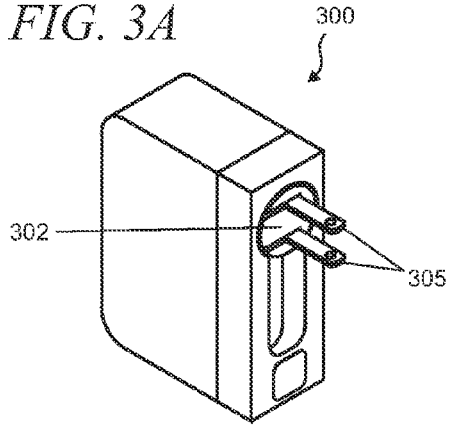
FIG. 3A is a pictorial view of the present AC power adapter where the prongs are rotated 90 degrees from the position shown in FIG. 3.

The swiveling plug 302 is configured to be rotatably coupled to the AC power adapter 300 so that the user may variably orient the adapter with respect to the prongs 305, and accordingly, with respect to an outlet to which the AC adapter 300 is plugged in. In this example, the plug 302 is arranged to swivel approximately 90 degrees as shown in FIG. 3A. The user may simply grasp the extended prongs 305 and rotate the plug 302 into a desired orientation with respect to the AC adapter 300.

Figure 11:
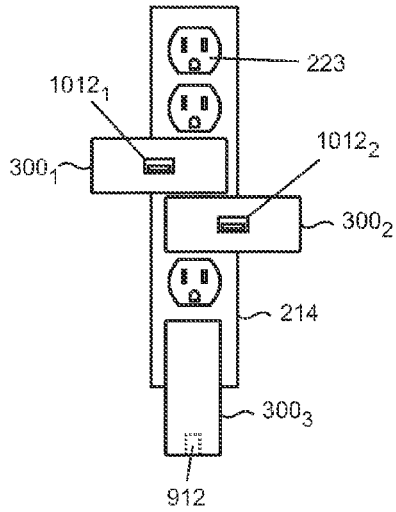
FIG. 11 shows an illustrative arrangement in which three of the present AC power adapters are plugged into a multiple-outlet power strip.
Figure 12:
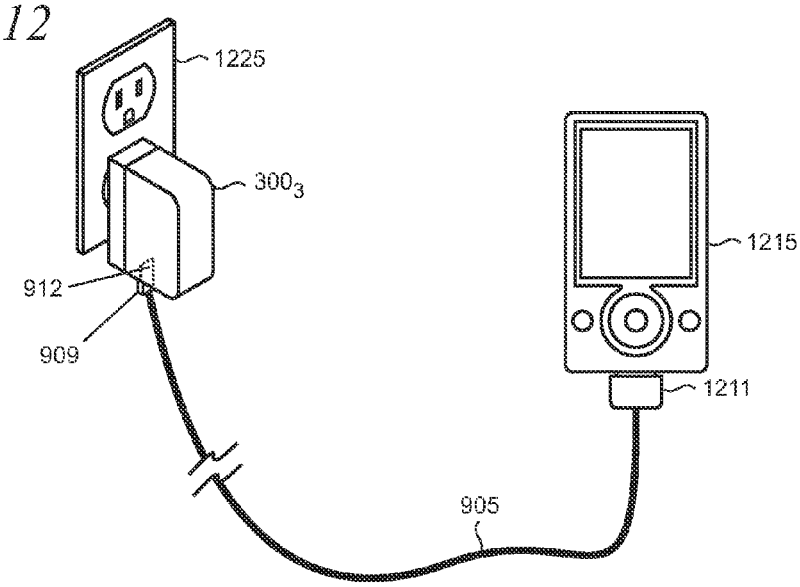
FIG. 12 shows an illustrative arrangement in which an example of the present AC power adapter is plugged into a wall outlet and is charging a personal media player through a DC charging or synchronization cable.
Figure 13:
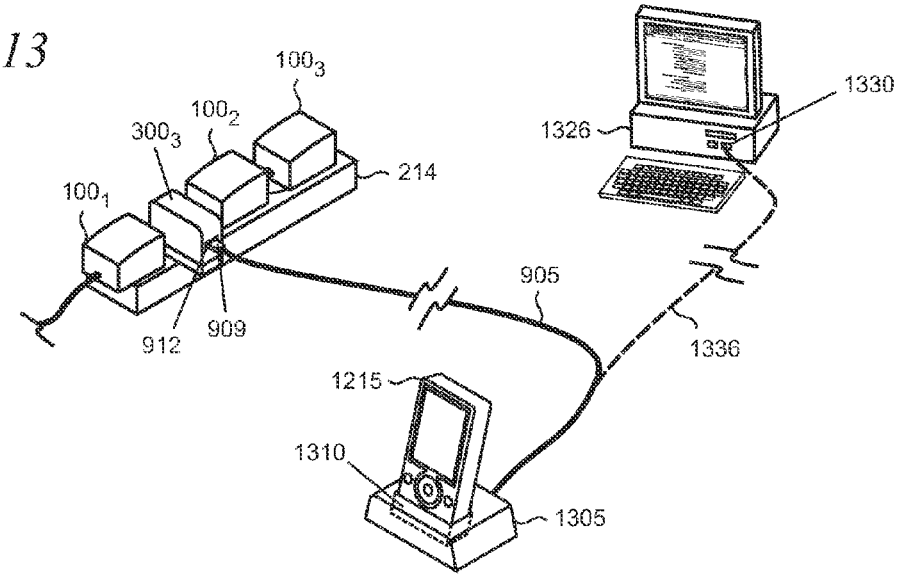
FIG. 13 shows an illustrative arrangement in which an example of the present AC power adapter is plugged into a multiple-outlet power strip along with several conventional AC power adapters, and the AC power adapter is powering a personal media player that is inserted into a dock.

The swiveling feature enables the long axis of the AC power adapter 300 to be oriented either in parallel or orthogonally with the long axis of a wall outlet or power strip, for example, as shown in FIGS. 11, 12, and 13. The ability to take on variable orientations, in combination with a compact overall size, enables the AC power adapter 300 with the swiveling plug 302 to plug into outlets where conditions are crowded by other adapters or plugs for other equipment. Rather than obstruct adjacent outlets, the AC power adapter 300 occupies only a single "space" on a wall outlet or power strip which maximizes the utilization of available outlets.

Figure 4:
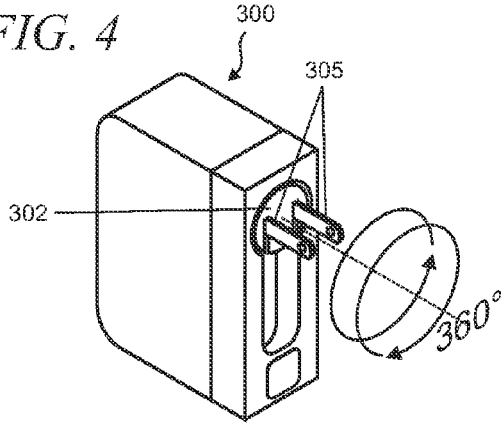
FIG. 4 is a pictorial view of the present AC power adapter showing an optionally-utilizable configuration where the plug may swivel in both clockwise and counterclockwise directions.

In alternative implementations, the swiveling plug 302 may be arranged to swivel beyond 90 degrees. For example, as shown in FIG. 4, the plug 302 is configured to rotate a full 360 degrees in both clockwise and counterclockwise directions. The rotation may also be continuous, just as a bicycle wheel can continuously spin on its axle. In some cases, the rotation can be infinitely variable where sufficient friction exists between the plug 302 and the adapter 300 to hold it in whichever angular rotational position is chosen by the user. In other examples, it may be desirable to include indexed positions of rotation where the plug 302 "snaps" or locks into one of several preset angular orientations as it is swiveled by the user, for example, 0, 45, 90, 135, 180 degrees, etc. It is as possible in some cases to constrain the rotation to other fixed ranges (e.g., 0-45, or 0-180 degrees, for example). Whether the swiveling of the plug 302 is constrained, and the type (i.e., indexed, infinitely variable), amount and direction of rotation provided in a given AC power adapter design will typically be selected as a matter of design choice to meet the requirements of a particular implementation.

Figure 5:
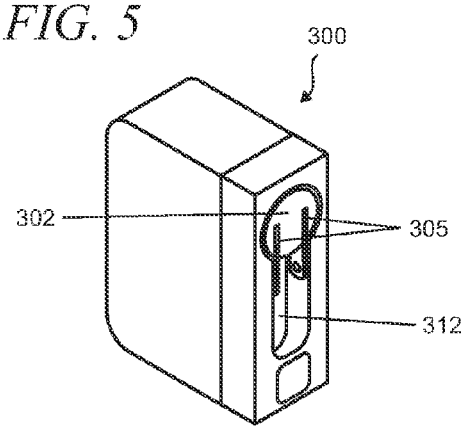
FIG. 5 is a pictorial view of the present AC power adapter where the prongs are folded into the body of the adapter for storage or transport.

Another significant feature is the ability of the prongs 305 to be folded into the AC power adapter 300 for storage or when transported. As shown in FIG. 5, the prongs may be folded into a recess 312 by pivoting orthogonally to the axis of rotation of the plug 302. The recess 312 is sized and shaped, in this example, to allow the trailing edges of the prongs 305 to be flush (or, in alternative configurations to be recessed) with the front face of the AC power adapter 300 when folded. Alternative arrangements for recess 312 could include, for example, individual slots for each prong 305.

When folded into the recess 312, the prongs 305 are protected against damage and are prevented from damaging or scratching other articles when the AC power adapter 300 is packed in a bag or suitcase, for example, during travel. (It is noted at this point that the designations of "front," "top," "bottom," "back" and similar terms are applied to the AC power adapter when oriented so that the line of sight of a viewer is parallel to the prongs 305 when extended. Accordingly, in the isometric views of FIG. 3, 4, and 5, front, top and left side faces of the AC power adapter 300 are visible).

The foldable prongs 305 are configured to pivot back and forth about a hinge having an axis that is orthogonal to the axis of rotation of the plug 302 in response to force applied by a user's fingers. Accordingly the recess 312 is further shaped to enable a user to insert a finger into the recess to pull the prongs 305 up into their extended position. Similarly, the user can swivel the plug 302 into a desired orientation by grasping the prongs 305 and rotating them and the plug 302 with respect to the body of the adapter 300. An alternative way to rotate the plug is for the user to extend the prongs 305, plug the AC power adapter 300 into an outlet, and then rotate the body of the adapter about the fixed prongs 305 into the desired orientation. While the foldable prongs will typically be desired for most implementations of the present AC power adapter, it is possible in alternative implementations to use fixedly positioned prongs that are not arranged to be foldable.

Figure 6:
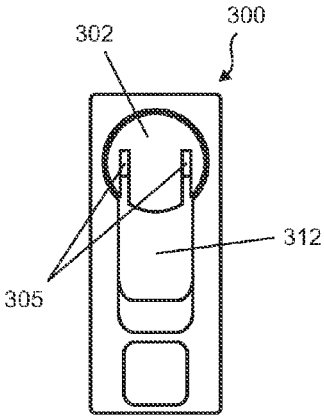
FIG. 6 is a front view of the present AC power adapter where the prongs are extended.
Figure 7:
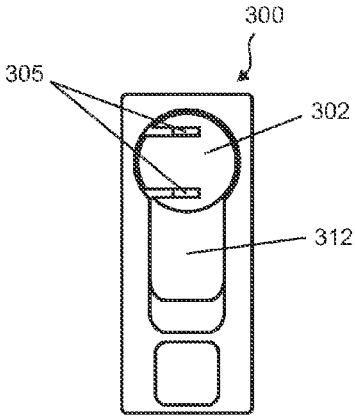
FIG. 7 is a front view of the present AC power adapter where the prongs are extended and rotated.
Figure 8:
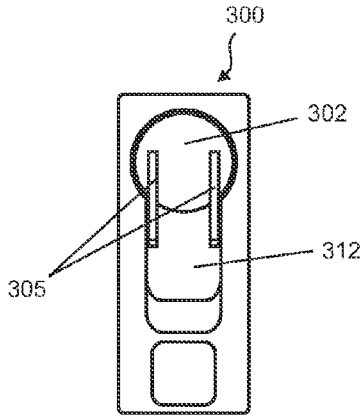
FIG. 8 is a front view of the present AC power adapter where the prongs are folded into the body of the adapter.

FIGS. 6, 7, and 8 show respective front views of the AC power adapter 300 when the prongs 305 are extended, extended and rotated 90 degrees, and folded.

In this illustrative example, the AC power adapter 300 is arranged to use a detachable DC power cable. In many implementations, the DC power cord also serves double duty as a data cable to enable electronic devices such as personal media players to operatively communicate with other devices like personal computers ("PCs"), for example, to synchronize data and/or share media content like music, video, and pictures. However, in other implementations it may be desirable to forgo the data-carry capability and utilize a cable that only provides DC power. In addition, it may be desirable to use a fixed (i.e., non-detachable) cable configuration in some applications.

Figure 9:
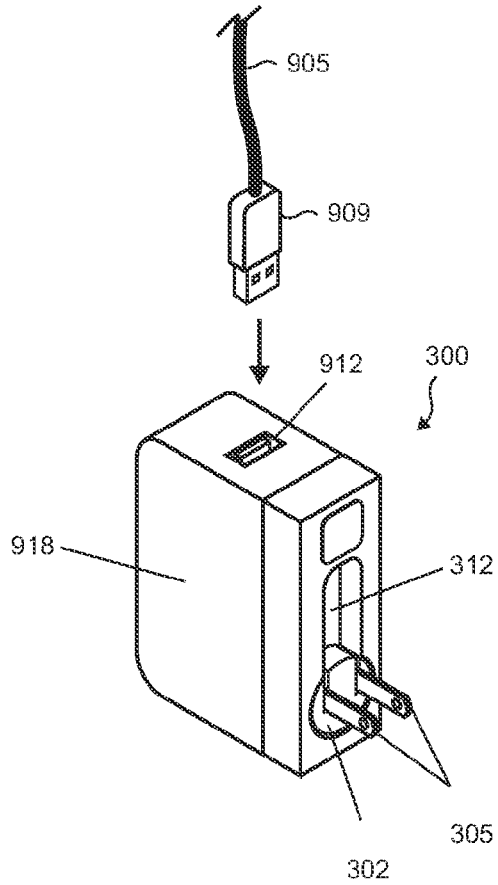
FIG. 9 is a pictorial view of a first configuration for a port in the present AC power adapter body that receives a detachable DC power cable.

As shown in FIG. 9, a synchronization ("sync") cable 905 uses a standardized USB (Universal Serial Bus) plug 909 that interfaces with a corresponding USB port 912 that is disposed in the body 918 of the AC power adapter 300 along its bottom face. The sync cable 905 here has multiple conductors that function to carry data signals as well as DC power. In alternative implementations, the plug 909 and port 912 may be arranged using other standard protocols such as IEEE-1394 (Institute of Electrical and Electronics Engineers), or a proprietary (i.e., non-standardized) plug/port pair combination may be utilized.

Figure 10:
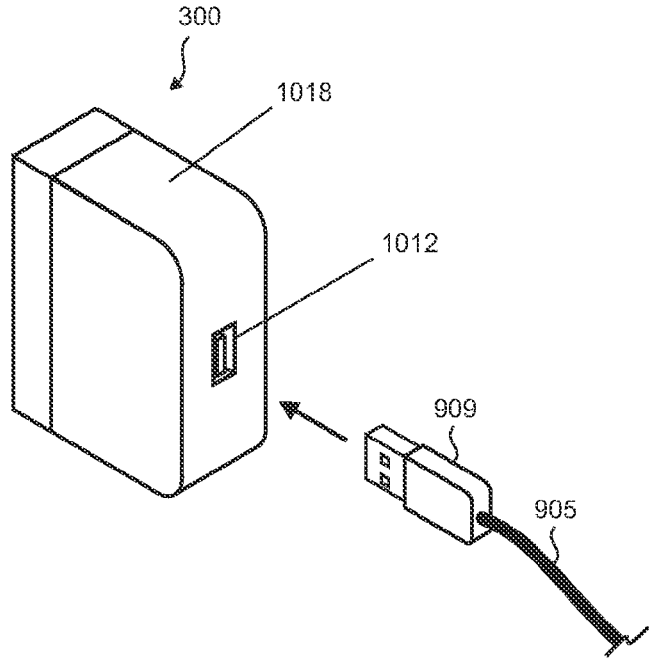
FIG. 10 is a pictorial view of a second configuration for a port in the present AC power adapter body that receives a detachable DC power cable.

FIG. 10 shows an alternative implementation where a USB port 1012 is disposed in the body 1018 of the AC power adapter 300 along the back face. As noted above, other connector types may be used. It is also emphasized that the location of the sync cable port may be positioned in other locations on the AC power adapter 300 as may be required to meet the needs of a particular application.

As noted above, the swiveling plug 302 enables the AC power adapter 300 to fit compactly into available spaces and take up less room than conventional adapters. FIG. 11 shows an illustrative arrangement in which three of the present AC power adapters $\mathbf{300}_1$, $\mathbf{300}_2$, and $\mathbf{300}_3$ are plugged into a multiple-outlet power strip 214. As shown, adapters $\mathbf{300}_1$, and $\mathbf{300}_2$ are in a rotated configuration where the plug 302 is swiveled 90 degrees so that the long axis of the adapter is orthogonal to the long axis of the power strip 214. Adapter $\mathbf{300}_3$ has its long axis parallel to the long axis of the power strip 214 and utilizes a USB port 912 that is located on the adapter's bottom face. Adapters $\mathbf{300}_1$ and $\mathbf{300}_2$ employ the alternative arrangement where the USB port 1012 for the sync cable 905 is located on the adapter's back face. As shown in FIG. 11, the three adapters 300 take up three spaces on the power strip 214 without blocking access to the remaining spaces on the strip.

As shown in FIG. 12, the end of the sync cable 905 opposite the USB plug 909 includes a device connector 1211 or plug that interfaces with an electronic device. In this example, the device is a representative personal media player 1215, such as an MP3 player (Moving Pictures Expert Group, MPEG-1, audio layer 3). Typically, the device connector 1211 is device-specific or proprietary (as compared with a universal connector such as the USB plug), and is configured to supply DC power and data signals to the appropriate mating connector in the device when the sync cable 905 is connected between the personal media player 1215 and another device such as a PC. Or, as shown in FIG. 12, the device connector 1211 provides just DC power when the sync cable 905 is coupled to the AC power adapter $\mathbf{300}_1$ which is shown plugged into a duplex wall outlet 1225.

FIG. 12 also highlights another feature provided by the present AC power adapter with swiveling plug. By enabling the AC power adapter 300 to be selectively oriented by the user, the plug 909 and sync cable 905 may be positioned to minimize strain on the cable and its connectors. As strain on electrical connectors can commonly cause conductors to become dislodged over time, it often is a source of intermittent or complete connection failure. By being able to plug the AC adapter into an outlet in a way that strain is reduced, connector and cable reliability is improved and user expectations regarding device performance are better met.

FIG. 13 shows the AC power adapter $\mathbf{300}_3$ plugged into the power strip 214 (which is also shown in FIG. 2) using the space left between two conventional adapters $\mathbf{100}_1$ and $\mathbf{100}_2$. In this example, the AC power adapter $\mathbf{300}_3$ is coupled to a dock 1305 with the sync cable 905. The personal media player 1215 is inserted into the dock 1305 which includes a port that is similar to that disposed on the bottom of the personal media player 1215 for receiving the device connector 1211 end of the sync cable 905.

Another device connector (not shown) is also located at the bottom of a well 1310 in the dock 1305 to interface with a mating connector in the personal media player 1215. The dock 1305 may generally be used to position the docked personal media player 1215 so that the player's display may be readily seen and the controls conveniently accessed by a user. While the dock 1305 may be used when the personal media player 1215 is being charged by the AC power adapter $\mathbf{300}_3$, another common use of the dock is to conveniently position the personal media player 1215 when it is being synchronized with a PC 1326. In this case, the USB plug 909 of the sync cable is plugged into an available USB port 1330 on the PC 1326 as indicated by the dashed line 1336.

Figure 14:
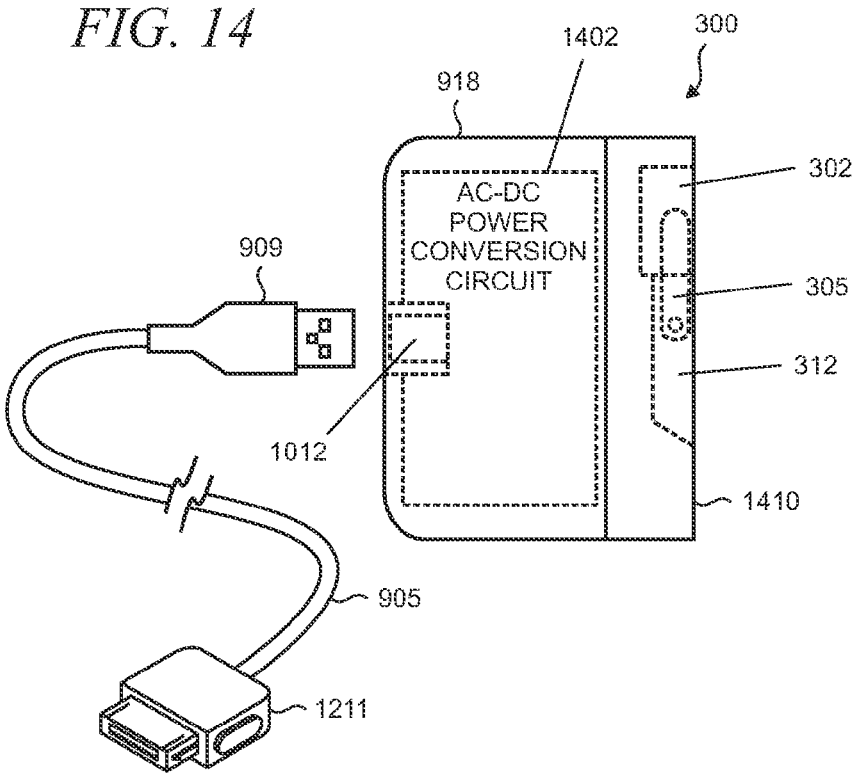
FIG. 14 is a side view of the present AC power adapter including phantom views of an AC-DC power conversion circuit that is disposed in the body of the adapter, and the swiveling plug with foldable prongs that is disposed in a detachable faceplate of the adapter.
Figure 15:
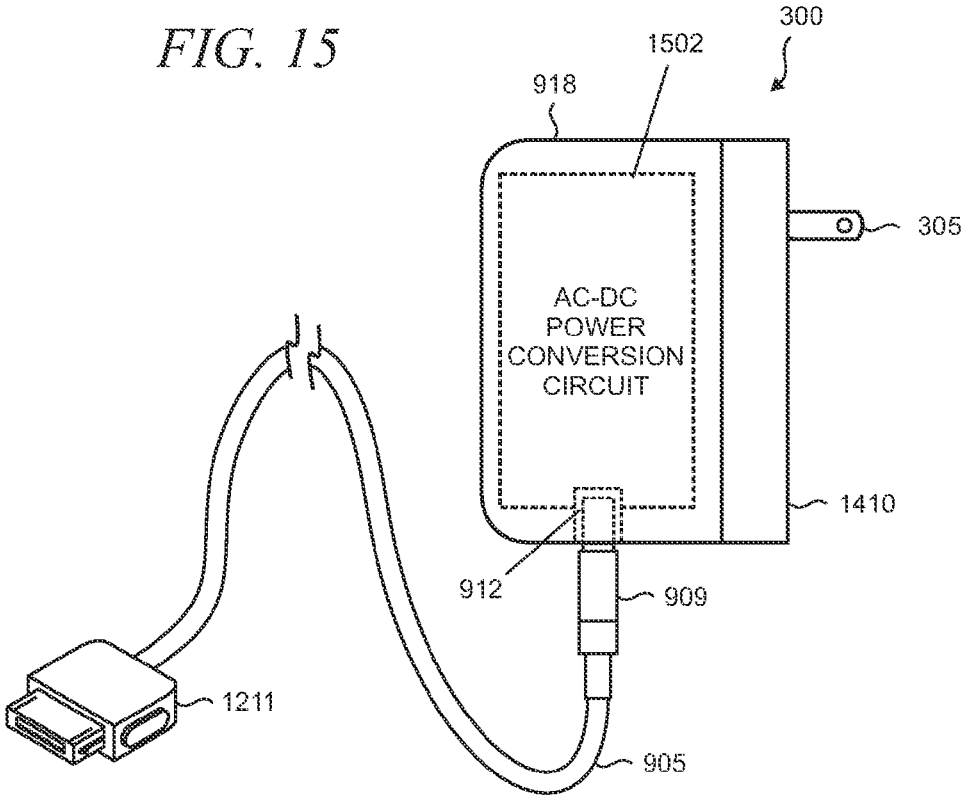
FIG. 15 is a side view of the present AC power adapter with the prongs in the extended position.

FIGS. 14 and 15 show additional details of the present AC power adapter 300. In particular, FIG. 14 shows a side view of the adapter 300 including phantom views of an AC-DC power conversion circuit 1402 that is disposed in the body 918 of the adapter 300, and the swiveling plug 302 with prongs 305 in their folded position that is disposed in a detachable faceplate 1410 of the adapter 300.

FIG. 15 shows a side view of the AC power adapter 300 with the prongs in the extended position. In this example, the location of the USB port 912 is located along its bottom face and is coupled to the AC-DC power conversion circuit 1502 along its short side, as shown.

The AC-DC power conversion circuits 1402 and 1502 may comprise one or more circuits as may be required to convert AC power received from the prongs 305 when plugged in an AC source to DC power according to specifications (e.g., voltage and amperage) that are required to meet the given design parameters for a particular application. In this regard, the AC-DC power conversion circuits 1402 and 1502 may be arranged conventionally according to known principles. Note that the connection between the prongs 305 and AC-DC power conversion circuits 1402 and 1502 is not shown for sake of clarity of illustration in FIGS. 14 and 15.

The body 918 and detachable faceplate 1410 will typically be formed from a resilient material such as polymer using a molding process. As both the body 918 and detachable faceplate 1410 contain energized components when the AC power adapter 300 is plugged in and functioning, they are generally configured to be capable of withstanding a variety of physical stresses, including drops, impacts, spills, and so forth. In addition, in some situations the adapter 300 will be placed on the floor, or behind furniture, etc., under uncontrolled and unobserved conditions, the AC-DC power conversion circuit (e.g., 1402, 1502) will be substantially sealed and encased in the resilient body 918 to prevent inadvertent contact with any energized component or circuitry.

Figure 16:
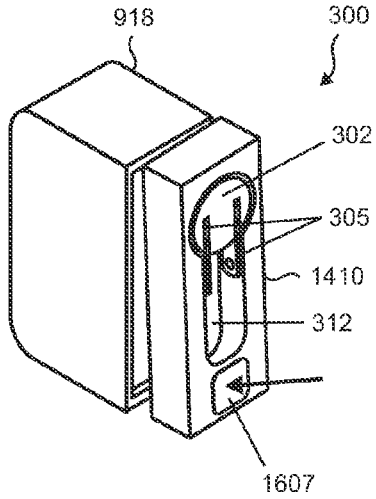
FIG. 16 shows the actuation of a button to release the detachable faceplate from the body of the AC power adapter.
Figure 17:
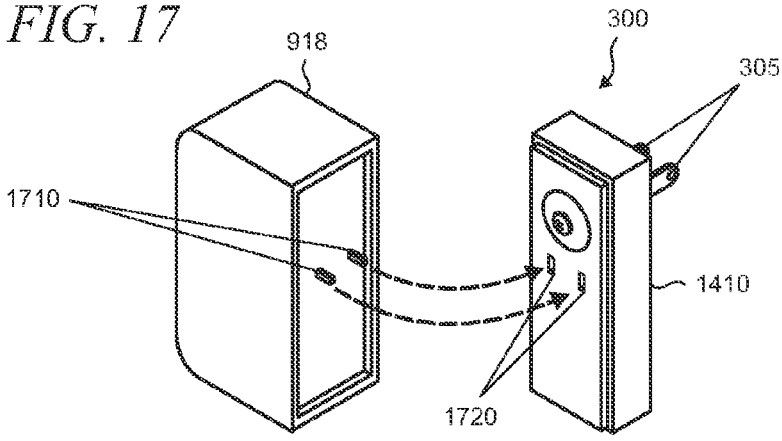
FIG. 17 shows details of the interior of the body and the back face of the detachable faceplate.
Figure 18:
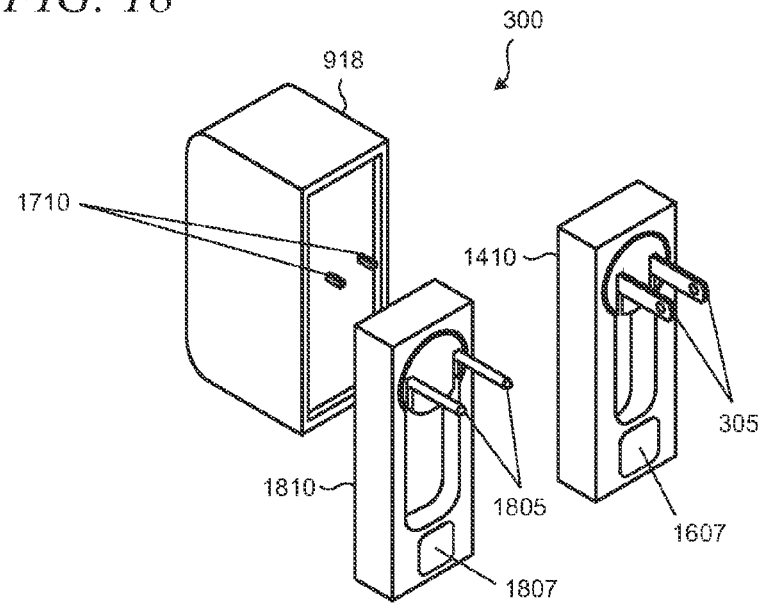
FIG. 18 shows two illustrative examples of interchangeable detachable faceplates, where the first example having a European Type C, 2-pin round prongs, and the second example is a North American/Japanese Type A, 2-pin flat-bladed prongs.

FIGS. 16-18 show another feature of the present AC power adapter 300 in which a plurality of different detachable faceplates, each with a different plug type, are arranged to be interchangeable. This feature enables a faceplate to be removed and swapped with one that includes a plug type that is appropriate for the local conditions. For example, a traveler from the United States bringing the personal media player 1215 shown in FIGS. 12 and 13 to Europe can swap a faceplate having a Type A plug with a faceplate having a Type C plug (popularly known as the Europlug) when arriving at the destination to charge the personal media player 1215.

FIG. 16 shows that the detachable faceplate 1410 may be released from the body 918 by user actuation of a mechanical release button 1607 as indicated by the arrow in the drawing. In this example, the release button 1607 is located on the front of the faceplate below the recess 312, and is normally biased against a spring or similar mechanism so that a positive force from the user is required on the button to release the detachable faceplate 1410. The detachable faceplate 1410 will thus not release from the body 918 during normal handling and use of the AC power adapter 300. However, the release mechanism will typically be configured so that an end-user may swap the faceplates by hand without the use of tools in the field.

Installation of a faceplate normally requires the faceplate 1410 be aligned with the body 918 and then pressed into place, typically with light finger pressure until it locks into place. Tactile feedback and an audible click will ordinarily indicate to the user that the faceplate is properly installed. In some cases, keyways, bosses, or guides may be utilized to facilitate the appropriate registration and alignment of the respective components, and/or to ensure that the faceplate 1410 can only be installed one way with the desired orientation to the body 918.

It is emphasized that the use of a release button on the front face of the faceplate is illustrative and that other configurations and means for enabling the faceplate to be removably attachable to the body 918 may be utilized. In alternative arrangements, it may be desirable to forgo the removable attachability feature, or to limit the interchangeability to factory or distribution environments only, for example, so that the faceplates are not ordinarily interchangeable in the field.

FIG. 17 shows details of the interior of the body 918 of the AC power adapter 300 and back face of the detachable faceplate 1410. AC power is transferred between respective mating connectors disposed in the interior of the body 918 and back face of the detachable faceplate 1410. As shown, male pin connectors 1710 engage into corresponding and mating female socket connectors 1720 when the faceplate 1410 is installed onto the body 918.

The female socket connectors 1720 are typically configured so that the conductive elements are recessed within the resilient polymer body of the faceplate in a similar manner as the conductors are recessed in a standard wall outlet. This ensures that energized elements are isolated and will not be inadvertently touched by a user in the event that the body 918 becomes detached from the faceplate 1410 while the prongs 305 remained plugged into an AC outlet, or a user plugs only the prongs in the faceplate itself 1410 (without a coupled body 918) into the outlet.

A variety of interchangeable and detachable faceplates having different plug configurations may be implemented and utilized. FIG. 18 shows two such faceplates—the detachable faceplate 1410 having a Type A plug with flat-bladed prongs 305, and a detachable faceplate 1810 having a Type C Europlug with round 4 mm pins as described in European Standard EN 50075, as indicated by reference numeral 1805 in FIG. 18.

Other plug types with two prongs usable with the present arrangement could include, for example, Type D, Type F, and Type I plugs. Faceplates with plugs utilizing three prong plugs such as Type J and may also be implemented in some cases, although foldable three-prong arrangements (in cases where the three-prongs are not substantially or approximately co-planar such as Type G, Type H, and Type K plugs) will not typically be as desirable as their two-prong counterparts because of the size of the faceplate would necessarily be increased to accommodate the folding feature. However, such three-prong plugs may still be arranged to swivel and thus enable the benefits thereto.

In addition to providing an easily user-configurable AC power adapter that can be used to power and charge devices used by international travelers, the manufacturing, inventorying, and distribution for the present AC power adapter may be made more efficient or simplified through utilization of the interchangeable detachable faceplates. Manufacturing dynamics and economics are improved because the body 918 of the AC power adapter, which contains the higher value power conversion circuit 1402 (with International power-handling capability), is commonly utilized by all adapters intended for sale in worldwide markets. Region-specific faceplates with AC plug types that match the configuration of local outlets can be manufactured, inventoried, assembled to AC power adapter bodies, and distributed according to demand for that particular product. This advantageously reduces the number of different variations in AC power adapters that are produced to address worldwide markets.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. An external AC power adapter, comprising:

a body formed from a resilient material and arranged to isolate electrically energized components housed therein;

AC-DC power conversion circuitry housed in the body, the AC-DC power conversion circuitry arranged for converting an AC power input to a DC power output; and a faceplate configured to be removably attachable to the body, the faceplate comprising:

a plug that is swivelably coupled to the body and including electrical contacts coupled to an AC circuit portion of the power conversion circuitry, the electrical contacts being coupled to the plug so that electrical contacts are foldable between a stowed position and an extended position, the electrical contacts being further arranged for mateable engagement with corresponding contacts in an AC power receptacle when in the extended position, the plug being arranged to rotate at least 90 degrees with respect to the adapter for variably orientating the electrical contacts when in the extended position, and a user operable release mechanism disposed in a front face of the faceplate for releasing the faceplate from the body when the faceplate is attached to the body.

2. The external AC power adapter of claim 1 further including a DC output that is coupled to a DC circuit portion of the AC-DC power conversion circuitry.

3. The external AC power adapter of claim 2 in which the DC output includes a cable having a plurality of electrical conductors, a proximal end of the cable interfacing with the DC circuit portion of the AC-DC power conversion circuitry, and a distal end of the DC power cable having a device interface that includes a facility for delivering DC power from the DC circuit portion of the AC-DC power conversion circuitry to an electronic device.

4. The external AC power adapter of claim 2 in which the DC output includes an output jack that is disposed in the body and arranged to interface with a connector disposed at a proximal end of a cable, the cable having a device interface at a distal end that includes a facility for delivering DC power to an electronic device.

5. The external AC power adapter of claim 4 in which the output jack, connector, cable, and device interface are each compliant with USB.

6. The external AC power adapter of claim 1 in which the body includes an electrical contact receiving area for receiving the electrical contacts when the electrical contacts are folded into the stowed position.

7. The external AC power adapter of claim 6 in which the electrical contact receiving area is selected from one of recess in the body or a plurality of slots in the body in which each slot in the plurality is configured to receive a respective electrical contact.

8. The external AC power adapter of claim 1 in which the adapter comprises two body portions, the plug being swivelably coupled to a first portion of the body and the power conversion circuitry being housed in a second portion of the body, the two portions of the body being removably couplable.

9. The external AC power adapter of claim 1 in which the electrical contacts are selected from one of flat-bladed prongs or pins.

10. The external AC power adapter of claim 1 in which the electrical contacts pivot about a hinge having an axis that is orthogonal to an axis of rotation of the plug when swiveled.

11. An external AC power adapter comprising:

a body formed from a resilient material and arranged to isolate electrically energized components housed therein;

AC-DC power conversion circuitry housed in the body, the AC-DC power conversion circuitry arranged for converting an AC power input to a DC power output; and a plug that is swivelably coupled to the body and including electrical contacts coupled to an AC circuit portion of the power conversion circuitry, the electrical contacts being coupled to the plug so that electrical contacts are foldable between a stowed position and an extended position, the electrical contacts being further arranged for mateable engagement with corresponding contacts in an AC power receptacle when in the extended position, wherein the adapter comprises two body portions, the plug being swivelably coupled to a first portion of the body and the power conversion circuitry being housed in a second portion of the body, the two portions of the body being removably couplable;

wherein the first portion of the body that is coupled to the plug comprises a faceplate that is configured to be removably attachable to the second portion of the body that contains the power conversion circuitry, the faceplate comprising:

a user-operable release mechanism disposed in a front face of the faceplate that when actuated releases the faceplate from the second portion of the body when the faceplate is attached to the second portion of the body;

a set of female electrical connectors arranged for mateable engagement with corresponding male electrical connectors when the faceplate is attached to the second portion of the body, the male connectors outwardly projecting from the second portion of the body and operatively coupled to the AC-DC power conversion circuitry, the female connectors being accessibly recessed in a back face of the faceplate and when engaged with the male connectors provide a source of AC power to the AC-DC power circuit when the electrical contacts of the plug are engaged with the corresponding contacts of a live AC power receptacle.

12. The external AC power adapter of claim 11 in which the plug is arranged as one of Type A plug or Type C plug.

13. The external AC power adapter of claim 11 in which the user-operable release mechanism is operable by hand without using tools.

14. The external AC power adapter of claim 13, the faceplate further including a locating feature that interoperates with a corresponding feature disposed on the second portion of the body so that the faceplate is attachable to the second portion of the body with a given orientation.

15. The external AC power adapter of claim 14, the faceplate further including a prong receiving recess that is arranged to receive the electrical contacts when in the stowed position.

16. The external AC power adapter of claim 11 in which the release mechanism includes a button.

17. The external AC power adapter of claim 16 in which the electrical contacts are arranged as foldable prongs that are hingedly moveable from a stowed position to an extended position in which the prongs project from the front face of the faceplate, the foldable prongs being arranged for removably mateable engagement with terminals in an AC outlet when in the extended position.

18. An external AC power adapter, comprising:

a body portion housing AC-DC power conversion circuitry arranged for converting an AC power input to a DC power output, the body portion having a set of electrical connectors operatively coupled to the AC-DC power conversion circuitry; and a faceplate configured to be removably attachable to the body portion, the faceplate comprising:

a plug including electrical contacts foldable between a stowed position and an extended position, the electrical contacts arranged to engage corresponding contacts in an AC power receptacle when in the extended position;

a user-operable release mechanism disposed in a front face of the faceplate for releasing the faceplate from the body portion when the faceplate is attached to the body portion; and a set of electrical connectors for providing a source of AC power to the AC-DC power circuit when engaged with the set of electrical connectors of the body portion when the electrical contacts of the plug are engaged with the corresponding contacts of a live AC power receptacle, wherein one of the set of the electrical connectors of the body portion and the set of electrical connectors of the faceplate comprises a set of male electrical connectors for engaging a set of female electrical connectors.

19. The external AC power adapter of claim 18, wherein the body portion is formed from a resilient material and arranged to isolate electrically energized components housed therein.

20. The external AC power adapter of claim 18, wherein the set of electrical connectors of the body portion comprises the set of male electrical connectors and the set of electrical connectors of the faceplate comprises the set of female electrical connectors.

* * * * *